US008205276B2

(12) United States Patent
Ge et al.

(10) Patent No.: US 8,205,276 B2
(45) **Date of Patent: *Jun. 26, 2012**

(54) PRESSURIZED DUAL FLUSH SYSTEM

(75) Inventors: Ming Ge, Farmington Hills, MI (US); Amer Mansour, West Bloomfield, MI (US); Jerry Sobolewski, Canton, MI (US); Phil Wenzel, Wixom, MI (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/179,873

(22) Filed: Jul. 11, 2011

(65) Prior Publication Data

US 2011/0265257 A1 Nov. 3, 2011

Related U.S. Application Data

(63) Continuation of application No. 12/221,018, filed on Jul. 30, 2008, now Pat. No. 7,975,324.

(51) Int. Cl.
*E03D 1/14* (2006.01)

(52) U.S. Cl. ..... 4/326; 4/354; 4/363

(58) Field of Classification Search ..... 4/325, 326, 4/333, 334, 363, 364, 354, 360
See application file for complete search history.

(56) References Cited

U.S. PATENT DOCUMENTS

| | | | |
|---|---|---|---|
| 520,358 | A | 5/1894 | Howell |
| 2,212,943 | A | 8/1940 | Kolarik |
| 3,719,958 | A | 3/1973 | Wilhelm |
| 3,732,577 | A | 5/1973 | Moon |
| 4,407,026 | A | 10/1983 | Myers |
| 4,543,674 | A | 10/1985 | David |
| 4,566,140 | A | 1/1986 | Musgrove |
| 4,667,350 | A | 5/1987 | Ikenaga et al. |
| 4,985,944 | A | 1/1991 | Shaw |
| 5,067,180 | A | 11/1991 | Figeroid |
| 5,148,555 | A | 9/1992 | Doyle |
| 5,802,628 | A | 9/1998 | Spoeth et al. |
| 5,813,059 | A | 9/1998 | Wang |
| 5,857,224 | A | 1/1999 | Oberg et al. |
| 6,029,287 | A | 2/2000 | Ge et al. |
| 6,029,288 | A | 2/2000 | Ge et al. |
| 6,173,456 | B1 | 1/2001 | Nieto |
| 6,212,699 | B1 | 4/2001 | Tremblay |
| 6,317,899 | B1 | 11/2001 | Brewer |
| 6,336,233 | B1 | 1/2002 | Shaw et al. |
| 6,550,076 | B1 | 4/2003 | Fish |
| 6,571,400 | B1 | 6/2003 | Reid |
| 6,785,913 | B2 | 9/2004 | Ho |
| 7,010,816 | B2 | 3/2006 | Li |
| 7,653,951 | B2 | 2/2010 | Gübeli et al. |
| 2003/0061652 | A1 | 4/2003 | Fish |
| 2005/0172387 | A1 | 8/2005 | Higgins |

OTHER PUBLICATIONS

"Flushmate, How It Works", Sloan Valve Company, http://www.flushmate.com/HowItWorks/default.asp, Oct. 23, 2007, 3 pages.

*Primary Examiner* — Gregory Huson
*Assistant Examiner* — Janie Christiansen
(74) *Attorney, Agent, or Firm* — Foley & Lardner LLP

(57) ABSTRACT

A dual flush volume pressurized flush device. A pressurized tank includes a tray for controllably retaining water during a flush event. The tray retains a certain volume of water when a reduced flush is activated, such that the entire volume of the tank is not flushed. In a full flush event, the activation causes substantially the entire volume of the tank to be flushed, including the volume of water inside the tray. A controllable water retention tray valve is positioned in the tray and provides a controllable release for the water in the tray.

20 Claims, 9 Drawing Sheets

PRESSURIZED DUAL FLUSH SYSTEM

CROSS-REFERENCE TO RELATED APPLICATIONS

This application is a continuation of U.S. patent application Ser. No. 12/221,018, filed Jul. 30, 2008. The contents of this application are incorporated herein by reference in its entirety.

BACKGROUND OF THE INVENTION

The field of the invention relates to pressurized flush systems, more particularly pressurized flush systems having more than one user selected flush volume.

Water conservation has extended into most aspects of building planning and operation. This includes restroom fixtures such as urinals and water closets. Among the specific types of water closets, some utilize a pressurized flush tank to provide additional water pressure during a flush event beyond that provided by typical "gravity"-type flush systems. It has been recognized that traditional restroom fixtures were designed with a flush volume to handle a maximum design load. Yet typical usage does not approach this maximum amount, and waste can be cleared using a lesser volume of water. It is generally recognized that a pressurized flush provides benefits in the distance the flush volume "carries" in the drain pipe, as well as in allowing for a reduced water volume to clear any debris in the water closet.

Thus, design trends have moved towards providing users of a restroom the ability to use a reduced volume of water (a "reduced flush") in certain situations where a full volume of water (a "normal flush") is not needed, such as for clearing liquid waste or small amounts of waste paper. The ability to control the volume of water results in significant water savings.

SUMMARY OF THE INVENTION

One embodiment of the invention relates to a dual flush system for use with a pressure flushing tank. The dual flush system comprises a retention tray adapted to be disposed within the pressure flushing tank. The retention tray has a housing which defines a volume and comprises a bottom portion and a sidewall, and the retention tray is open to the pressure flushing tank at a top portion. A retention tray valve is disposed in the retention tray housing, with the valve providing a controllable opening through the housing. The retention tray valve has a valve seal engagable with a valve seat disposed in the housing and further is engagable with a valve stem for manipulating the position of the valve seal in relation to the valve seat. The frictional forces between the valve seal and the valve seat retain the valve in a closed position when the pressure flushing tank is filled.

In another embodiment, a water retention tray assembly is provided for use within a pressurized flush vessel. The water retention tray assembly comprises a tray housing defining a volume and being open on at least one side to the interior of the flush vessel. The water retention tray further includes a tray valve, the tray valve being positioned in the tray housing and providing controllable communication between the volume interior to the tray assembly and to an environment external to the tray assembly. The tray valve includes a valve seat and valve cover, the valve cover being in communication with a valve stem adapted to controllably open and close the tray valve. When a reduced flush event occurs, a first volume of water follows a first fluid flow path from the interior of the vessel through the flush valve and, when a full flush event occurs then a second volume of water follows a second fluid flow path from the interior of the vessel through the flush valve.

In yet another embodiment, a pressure flushing device comprises a flush vessel having a housing defining an internal volume and in communication with a water inlet line and water outlet line. The device further comprises a flush valve assembly disposed within the flush vessel for controlling the flow of water out of the flush vessel and having a flush actuator extending from the flush valve assembly through the housing and outside of the internal volume. The device includes a water retention tray assembly comprising: a tray housing defining a volume and being open on at least one side to the interior of the flush vessel, a tray valve, the tray valve being positioned in the tray housing and providing controllable communication between the interior of the tray assembly and the flush vessel and further including an actuation linkage assembly in communication with the flush valve and the tray valve, the actuation linkage assembly including an actuation rod extending from a valve stem of the valve upward through the flush vessel housing, the actuation linkage assembly further in communication with a flush valve actuator via a lever positioned on an outer surface of the flush vessel in communication with both the tray valve actuation rod and the flush valve actuator. The tray valve includes a valve seat and valve cover, the valve cover in communication with a valve stem adapted to controllably open and close the tray valve. The flush valve actuator is actuable via two mechanisms, the first engaging the linkage assembly to also actuate the tray valve to provide a large volume flush and a second mechanism whereby the flush valve is actuated and the tray valve is not activated, thereby providing a small volume flush.

BRIEF DESCRIPTION OF THE DRAWINGS

FIG. 7 shows the retention tray valve open;

FIGS. 9A-C illustrate one embodiment of a flush actuation mechanism for use with the structures of FIGS. 2-8 wherein FIG. 9A is a top-view of the flush actuation mechanism's buttons; FIG. 9B is a side-view of the flush actuation structure; and FIG. 9C is a cross-sectional view illustrating the height adjustment mechanism of the flush actuation mechanism;

DETAILED DESCRIPTION OF THE PREFERRED EMBODIMENTS

As discussed above, recent trends in consumer interest in water conservation have lead to a desire for flush mechanisms that can accomplish water savings over traditional systems. Certain flush systems rely on a pressurized flush to provide for a more forceful flow of water than is provided by more traditional gravity flow systems.

Figure 1:
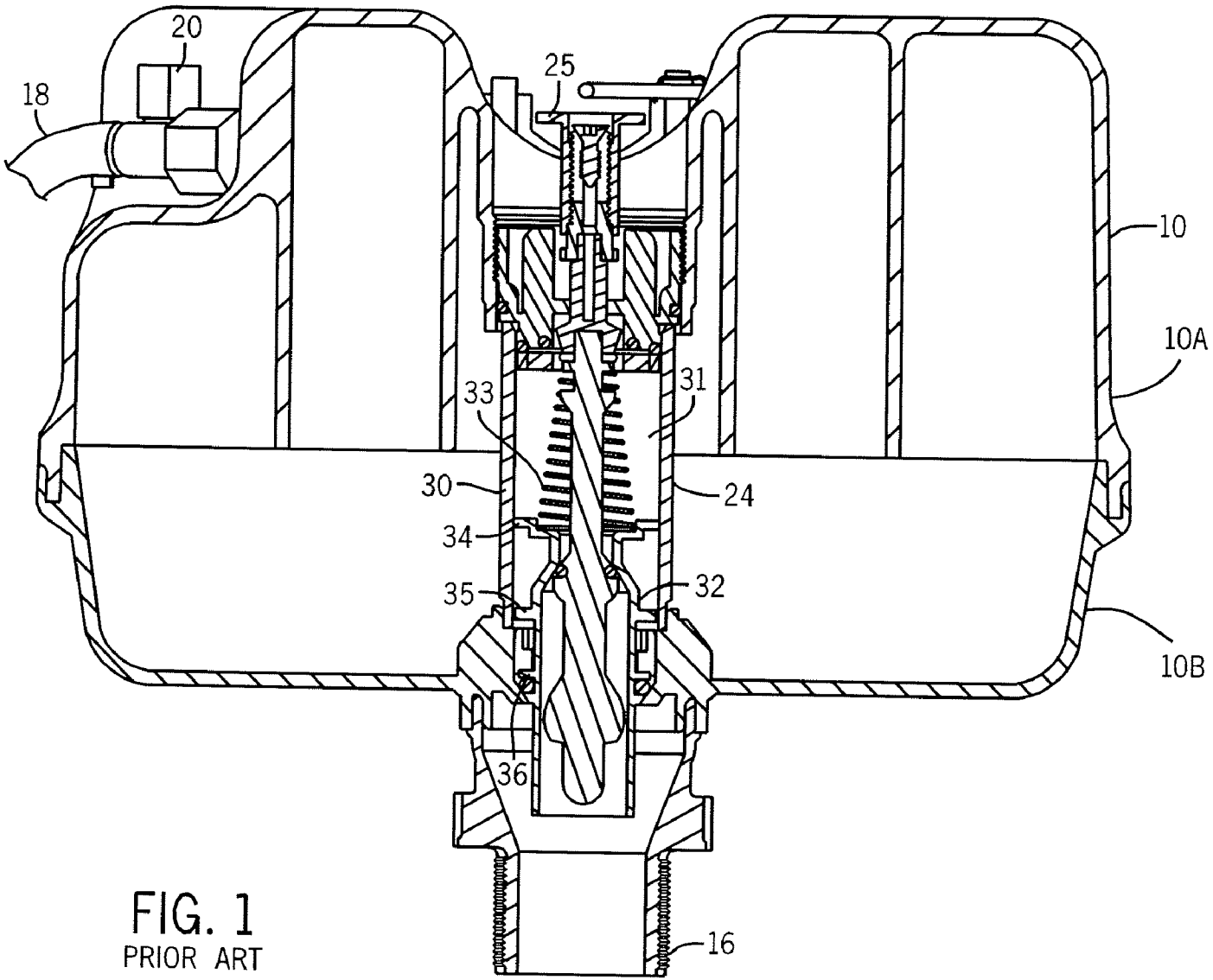
FIG. 1 PRIOR ART
FIG. 1 is an illustration of a prior art pressure flush vessel.

One type of pressurized system utilizes a tank that is pressurized by the water feed line pressure itself. FIG. 1 illustrates a typical prior art system, such as described in U.S. Pat. No. 4,233,698, incorporated herein by reference. The general system of FIG. 1 includes a tank 10, which may comprise an upper portion 10A and a lower portion 10B for ease of assembly, and the tank 10 receives water from a water supply line 18. Positioned between the water supply line 18 and the tank 10, is an air and water inducer 20. As described in the '698 patent, as water fed from the water supply line 18 passes through the air and water inducer 20, air is drawn into the tank 10 via a venturi effect. As a result of this, the air and water will pressurize the tank 10 to roughly the same pressure as that of the water supply line 18. The tank 10 will fill to a predetermined level of water and air.

The system of FIG. 1 utilizes a flush valve 24 to release the contents of the tank 10 and activate a flush cycle. The '698 patent describes in detail one type of flush valve that may be utilized. Generally, the flush valve 24 includes a flush valve sleeve 30. Within the flush valve sleeve 30 is disposed an inner column 32; and a control chamber 31 is defined by a space within the top of the outer sleeve 30 and bounded on the bottom by the inner column 32. The inner column 32 includes a plurality of flanges, in one preferred embodiment three flanges 34, 35, 36. The flanges 34, 35, 36 are sized to have a minimal amount of clearance with the outer sleeve 30. The amount of clearance is dictated, in part, by the desired flow pattern and volume as is understood in the art.

The pressure within the outer sleeve 30 and above the inner column 32 holds the inner column 32 against the action of a bias, such as spring 33, so that the flush valve flange 34 is sealed against the flush valve seat 36. The flush valve 24 is actuated via a flush valve actuator 25. The flush valve actuator 24 engages the flush valve and initiates a flush cycle.

When a flush cycle has been initiated, the system discharges water from the tank 10 through the flush valve 24 to a water outlet line 16, which is in communication with the bowl [not shown]. The flush valve 24 is positioned, in the embodiment of FIG. 1, substantially in the center of the tank 10.

Figure 2:
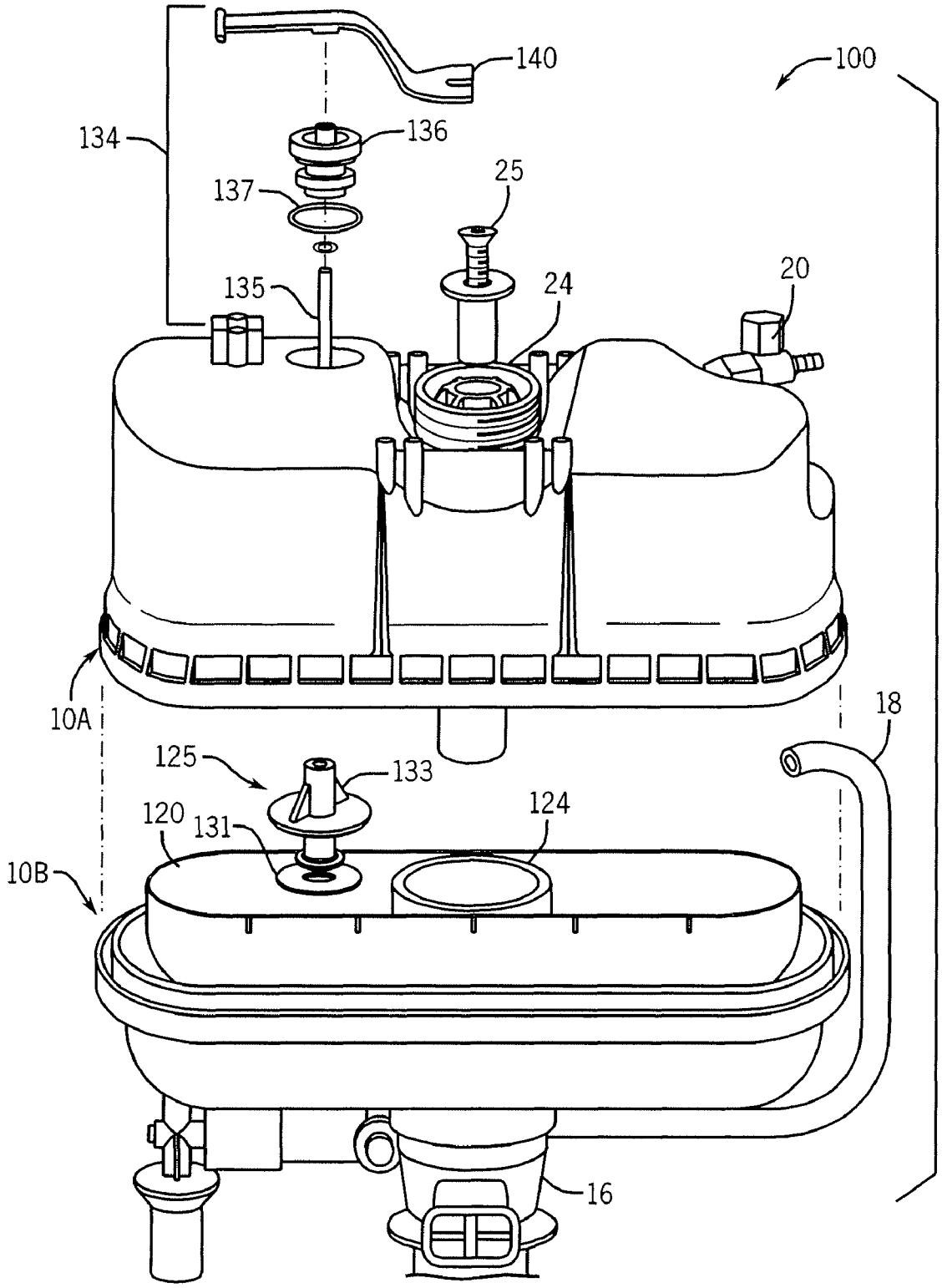
FIG. 2 is an exploded view of a pressure flush vessel having a water retention tray.

The present invention is directed to pressurized flush system 100 shown in FIG. 2 and having more than one flush volume, for example a dual flush system whereby a first "lower" or "reduced" flush utilizes a first volume of water and a second "higher" flush utilizes a second volume of water, the first volume being less than the second volume. FIGS. 2-8 illustrate preferred embodiments of the present invention having a retention tray assembly 110, which includes a retention tray 120. The retention tray 120 holds a portion of the total volume of water within the tank 10. While it should be appreciated that the retention tray 120 may be sized and shaped to retain a desired volume of water, either as a percentage of the total volume of the tank 10 or as an absolute volume, one preferred embodiment retains about 0.33 gallons (about 1.249 liters) of water. Thus, a flush which uses only the water not included in the retention tray 120 results in a smaller flush volume then a flush that utilizes all of the water in the tank 10, including the volume held within the tray 120.

The retention tray 120 is positioned within the tank 10, in an exemplary embodiment within the lower portion 10B of the tank 10. In one embodiment, the retention tray 120 is not fixed to the tank 10, but rather is positioned within the tank 10 to allow for some movement to accommodate the actuation mechanism described below. In the illustrated embodiments best shown in FIGS. 5 and 6, the retention tray 120 includes a bowl-shaped housing the tray 120 has a sidewall and a bottom, but substantially open at the top (illustrated in FIG. 5 as substantially four sides 122A-D and a bottom 122E with an open top 122F, the retention tray 120 defining a set volume within the tank 10). In one embodiment, the edges 123 where the sidewalls meet the bottom are rounded to encourage dispensing of all water in the tray 120 when the retention tray valve 125 is open. In one embodiment, the retention tray 120 extends substantially the entire width and length of the housing 10, such that it has substantially the same longitudinal cross-section as the housing 10. It should be appreciated that such an embodiment maximizes the amount of volume the retention tray 120 holds while allowing for various depths of the retention tray 120 to be designed, but various other shapes and/or sizes of the retention tray 120 may be utilized without varying from the scope of the invention.

Figure 5:
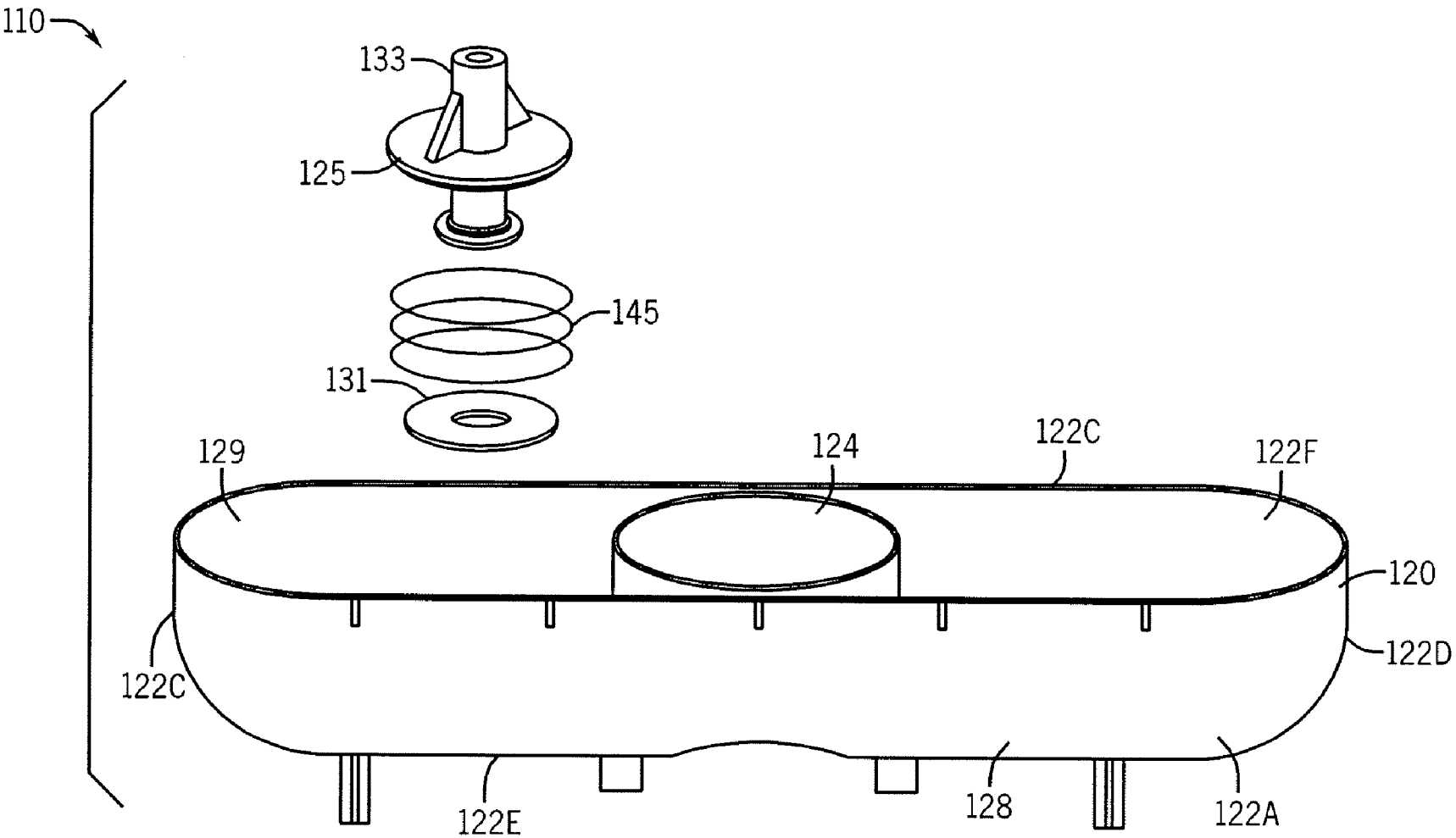
FIG. 5 is an exploded view of a water retention tray.
Figure 6:
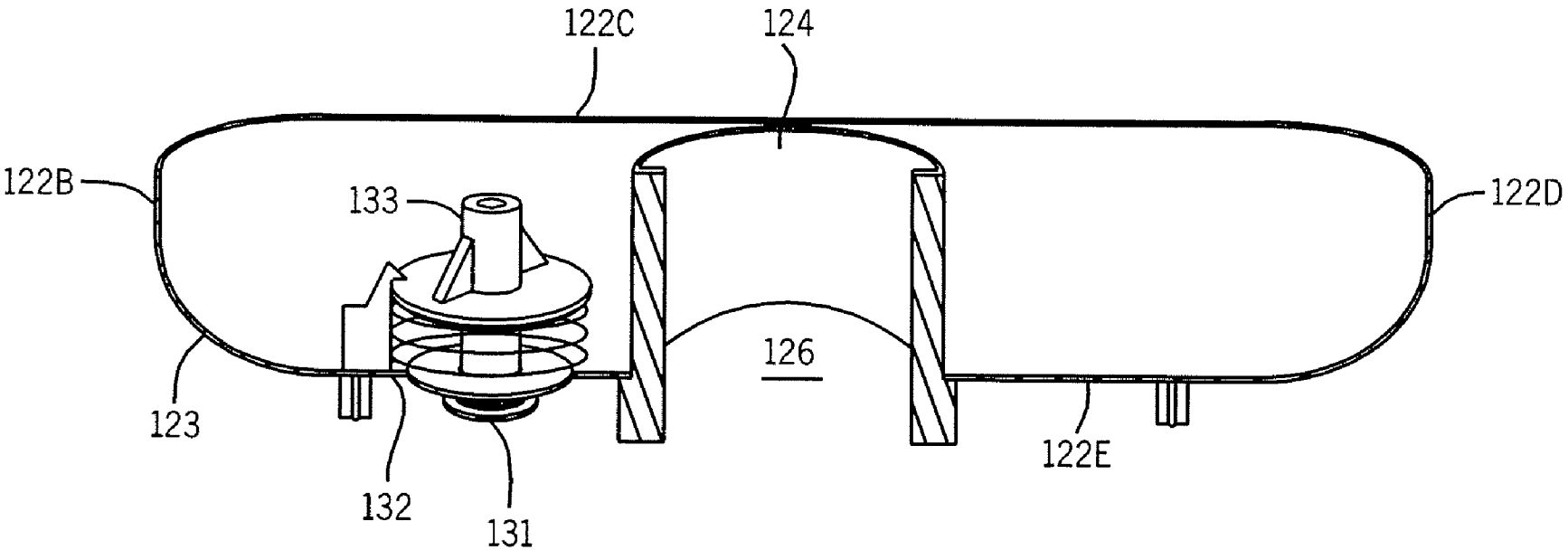
FIG. 6 is a cross-sectional view of the water retention tray of FIG. 5.

Referring to FIGS. 5 and 6, the retention tray 120, via an open top 122E is in fluid communication with the interior of the tank 10. Thus when water enters the tank 10 via a water intake port 19 the retention tray 120 is filled (as well as the tank 10). In one embodiment, the positioning of the water intake port 19 is such that water flows into the retention tray 120, filling the retention tray 120 and then overflowing from the retention tray 120 to fill the remainder of the tank 10. In this embodiment, the mixture of air and water taken in via the water inducer 20 results in the air filling the tank 10 while the water fills the retention tray 120. In an alternative embodiment, the water intake port 19 is positioned so as to fill the tank 10 whereby the retention tray 120 is not filled until the volume of water in the tank 10 rises above the retention tray 120, such as by the intake port 19 channeling water along a side of the tank 10 without entering the tray 120. In one embodiment, the retention tray 120 includes a substantially central opening 124 through which the flush valve 24 passes. The bottom portion 122E may curve upward forming a central column 126 defining the central opening 124, which is in one embodiment substantially the height of the walls 122A-D, so as to allow the tray 120 to retain water.

The water retention tray assembly 110 further includes a retention tray valve 125 positioned on the retention tray 120. The retention tray valve 125 provides a controllable passage through which the retention tray 120; and the interior of the tank 10 can be placed in fluid communication. Thus water in the tank 10 is generally provided via two fluid flow paths. One path, which is always "open", is around the retention tray 120, either around the outside of the retention tray 120, through the central opening 124, or both. The second path, which is controllably opened and closed, is through the retention tray 120 via the retention tray valve 125.

The placement of the retention tray valve 125 within the tray 120 may affect the amount and effectiveness of the drainage of the volume of the retention tray 120 during a flush event. The retention tray valve 125 is placed, in one embodiment, in the bottom side 122E of the retention tray 120.

The retention tray valve 125 may utilize various types of valves known in the art. For example, in one embodiment, the retention tray valve 125 comprises a valve cover 131 (such as disk-type valve utilizing a disk as a valve cover 131), a valve seat 132, and a valve stem 133. The disk 131 sealingly engages the valve seat 132 to seal the retention tray valve 125 enabling the retention tray 120 to retain water during a flush event. In a preferred embodiment, the seal formed between the valve seat 132 and the disk 131 is water-tight. However, in alternative embodiments, there exists some minimal degree of leakage through the retention tray valve 125; but nevertheless, is significantly less than the amount of water retained within the retention tray 120 during a flush event. It will be appreciated, that in certain embodiments a biasing mechanism 145 may be used to assist in either retaining the valve cover 131 on the valve seat 132 or in removing the valve cover 131 from the valve seat 132.

Figure 3:
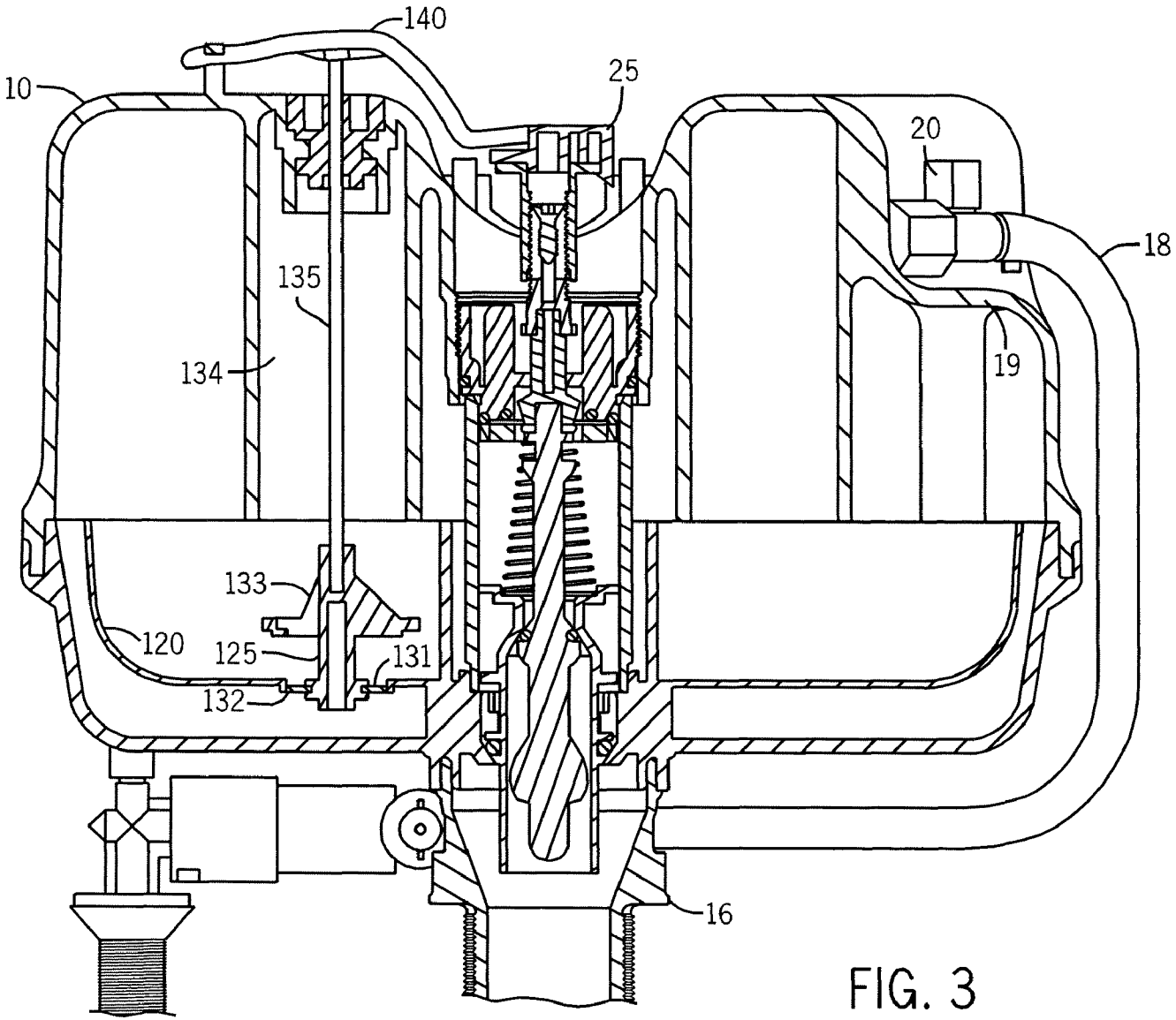
FIG. 3 is a cross-sectional view of the pressure flush vessel of FIG. 2 including a "push off" structure for the tray valve and illustrating the retention tray valve closed.
Figure 4:
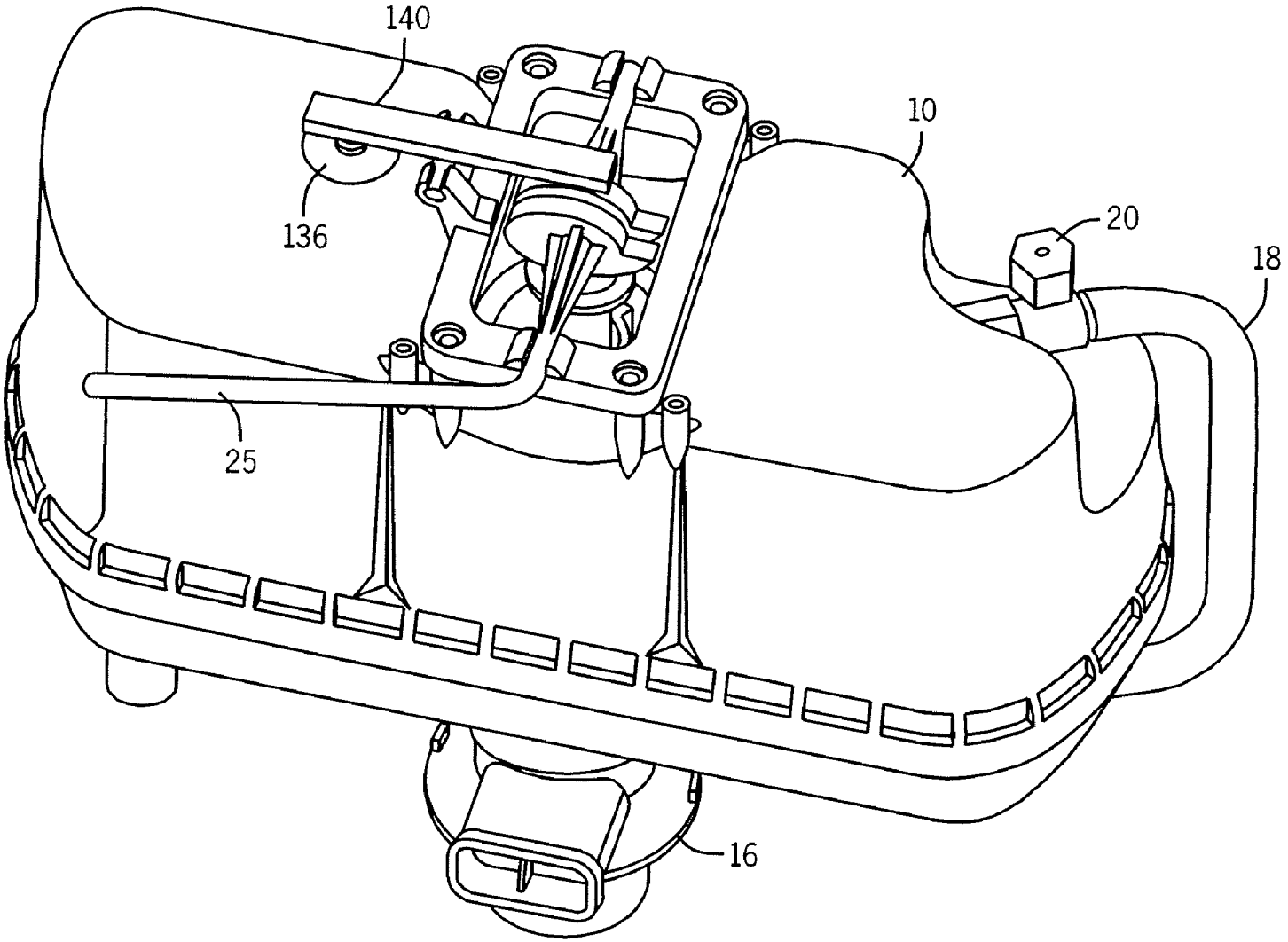
FIG. 4 is a perspective view of the actuation mechanism of a flush vessel having a water retention tray.
Figure 7:
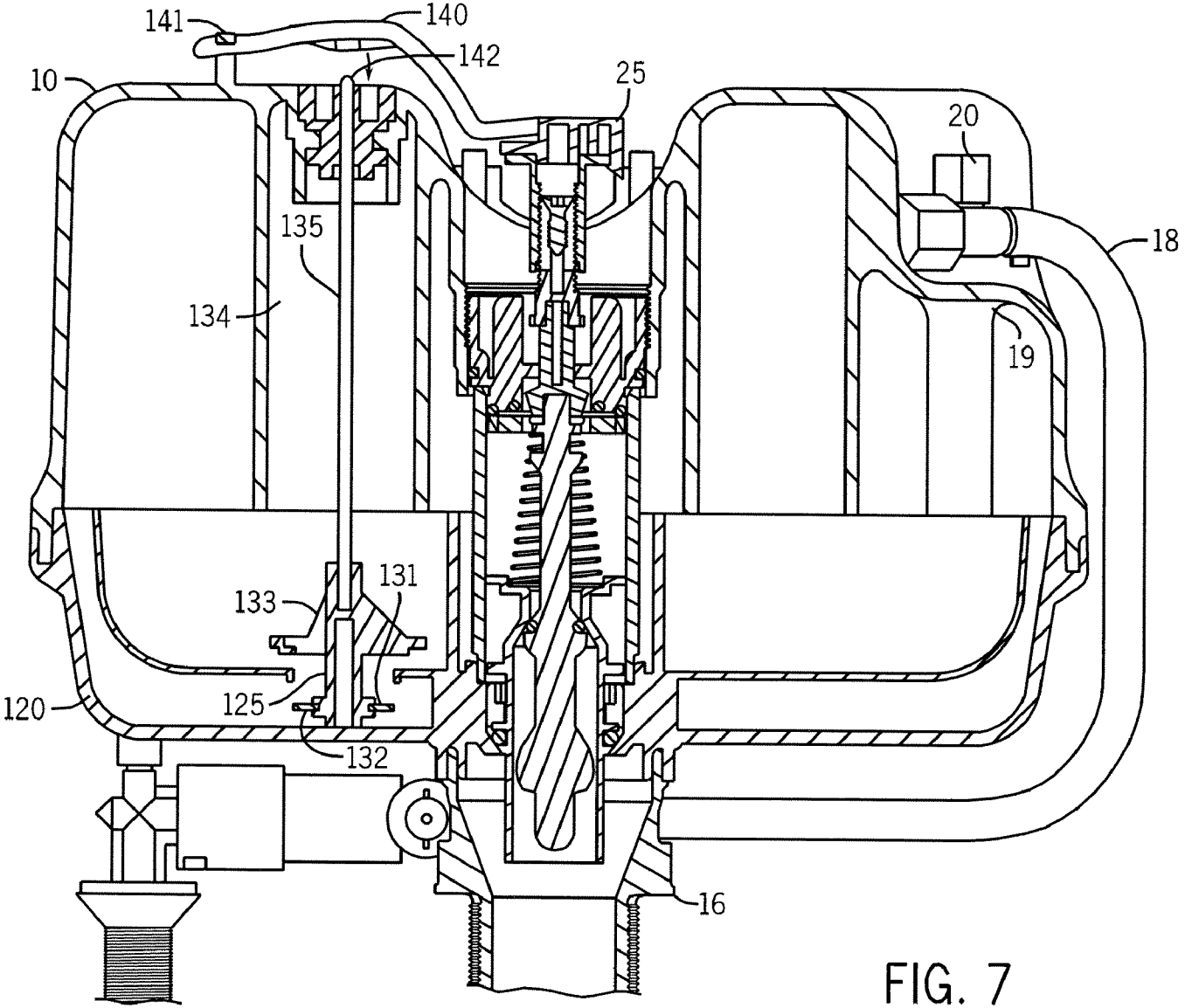
FIG. 7 illustrates a retention tray valve utilizing a "push off" structure, where

As shown in FIG. 3 and FIG. 7, in an alternative embodiment, the disk 131 and valve seat 132 are positioned on an exterior surface 128 of the retention tray 120 with the stem 133 extending upwards toward the top of the tank 10. In this embodiment, the disk 131 is "pushed" off the valve seat 132 generally downward towards the bottom of the tank 10. FIG. 3 illustrates this embodiment in a closed state, and FIG. 7 illustrates an open state. The embodiment of FIGS. 3 and 7 results in the "default" position of the retention tray valve 125 being closed; and therefore the default flush is a reduced flush. In addition, this embodiment operates such that if the retention tray valve 125 fails, the system will operate in a full flush mode, with the valve being "stuck" open and the retention tray 120 contents draining each flush cycle. It should be appreciated that a similar structure may be utilized, in another embodiment, wherein the disk 131 is exterior to the retention tray 120; but the default position of the retention tray valve 125 is open. Thus, the disk 131 would be pulled onto the valve seat 132 during a reduced flush event, resulting in the retention tray 120 retaining its water volume and a reduced flush cycle occurring.

Figure 8:
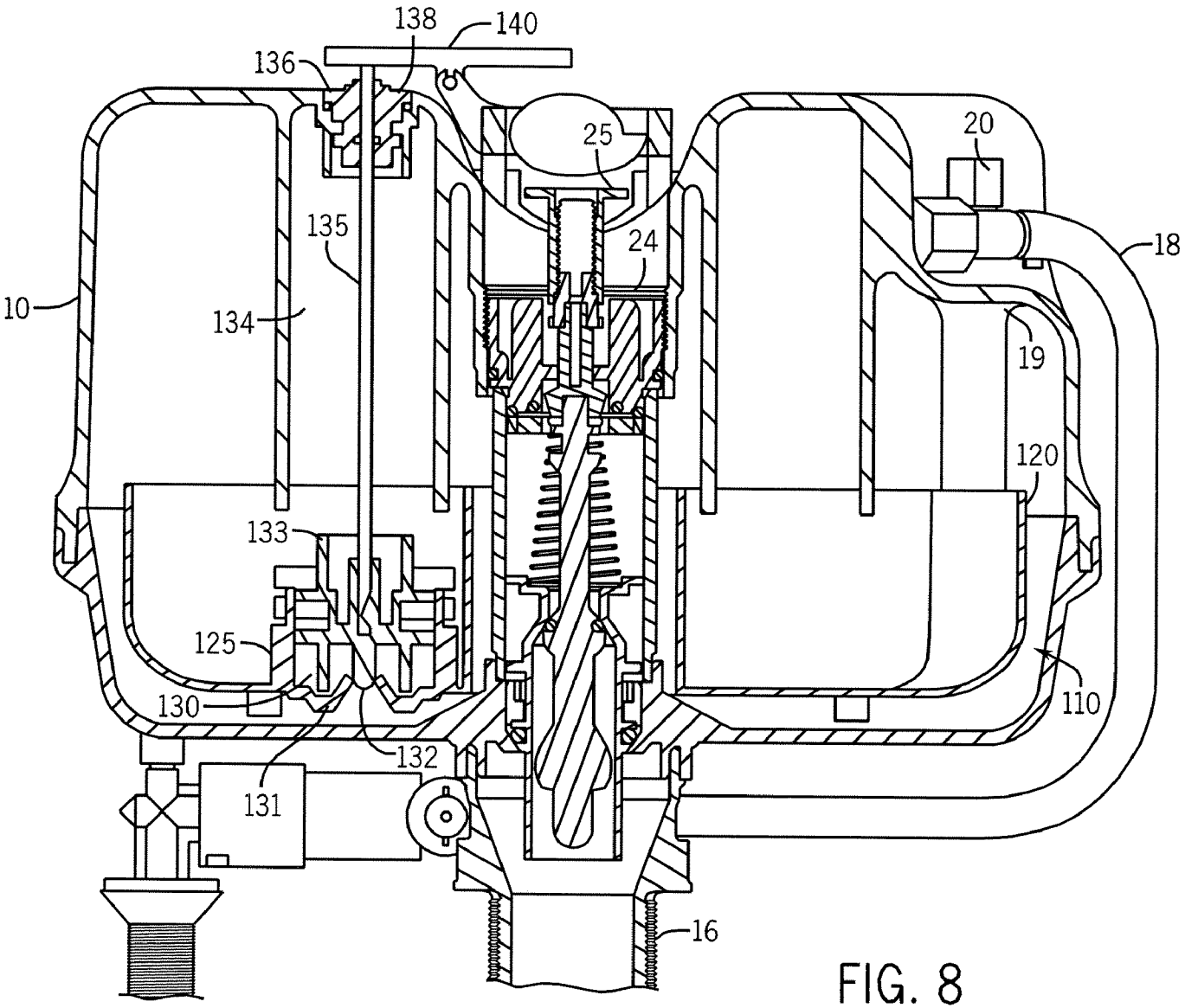
FIG. 8 illustrates a retention tray valve utilizing a "pull off" structure.

As show in FIG. 8, the retention tray valve 125 may be positioned such that it engages an inside surface 129 of the retention tray 120 with the stem 133 extending upwards toward the top of the tank 10. In this embodiment, the disk 131 is "pulled" off the valve seat 132 generally upwards towards the top of the tank 10. In this embodiment, the pressure exerted by the water and air in the tank operates to force the disk 131 against the valve seat 132. The movement of the valve stem 133 must overcome any frictional forces plus the forces exerted by the water and air to "unseat" the disk 131. A conventional biasing mechanism 130, such as, but not limited to, a spring, can be used to bias the disk 131 away from the valve seat 132 to in whole, or in part, counterbalance the frictional forces and the pressure exerted by the air and water in the tank 10.

The embodiment of FIG. 8 results in the "default" position of the valve 125 being open, and therefore the default flush is a full flush. In addition, this embodiment operates such that if the retention tray valve 125 fails, the system should operate in a full flush mode, with the retention tray valve 125 being "stuck" open if a biasing mechanism 130 is used or the retention tray valve 125 would be "stuck" in a closed position if no bias is present. Thus, ensuring that even if the dual volume aspect fails, a sufficient (i.e., the full) flush volume will be provided. It should be appreciated that a similar structure may be utilized, in another embodiment, wherein the disk 131 is interior to the retention tray 120, but the default position of the retention tray valve 125 is closed. Thus, the disk 131 would be pulled off of the valve seat 132 during a full flush event, resulting in the retention tray 120 expelling its water and a full flush cycle occurring.

It should be appreciated that when the tank 10 is drained, the water within the retention tray 120 will retain the set volume of water unless the retention tray valve 125 is open. Thus, two flush volumes can be achieved. The first, lower, flush volume occurs when the retention tray valve 125 is closed; and a set volume of water is retained (held back from the flush cycle) within the retention tray 120 when a flush event occurs. In the second mode, a higher flush volume occurs when the retention tray valve 125 is open during a flush event; and the set volume of water within the retention tray 120 drains from the retention tray 120 and is added to the flush cycle.

In an exemplary embodiment of the invention, the retention tray valve 125 is actuated via a retention tray valve actuation linkage assembly 134 as best shown in FIGS. 3, 7, and 8. The retention tray valve actuation linkage assembly 134 includes an actuation rod 135 that extends, in one embodiment, substantially perpendicular to the retention tray 120 and parallel to a longitudinal axis of the flush valve 24, from the valve seat 132 to a linkage housing 136, which extends through the tank 10. The linkage housing 136 may include at least one seal 137, such as an O-ring, to seal the linkage housing 136 with the tank 10 to preserve the integrity of the interior of the tank 10 when under pressure. In one embodiment, the linkage assembly 134 is held in place, at least in part, due to friction with a retention member within the housing 136, such as "U-cup" 138. The actuation rod 135 extends though the U-cup 138 and out the linkage housing 136. The actuation rod 135 extends a sufficient amount from the housing 136, outside of the tank 10, so as to be depressible to actuate the retention tray valve 125.

In one embodiment, a lever 140 is provided for engaging the linkage portion that extends from the linkage housing 136. The lever 140 is pivotably affixed, such as at one end 141, to the outer surface of the tank 10. The lever 140 is engagable with the actuation rod 135, such as at a protrusion 142. Pressing the lever 140 will actuate retention tray valve 125. Thus, for embodiments wherein the resting state of the retention tray valve 125 is open, the lever 140 is actuated to close the retention tray valve 125, thereby allowing for a reduced flush volume. In contrast, for those embodiments where the resting state of the retention tray valve 125 is closed, actuation of the lever 140 results in the retention tray valve 125 opening; and a full flush volume is enabled.

It should be appreciated that various arrangements of actuation schemes can be presented to a user by providing mechanical (or electromechanical) translation of the user's input to movement of the flush valve actuator and the linkage assembly 134. For example, the lever 140 described above may extend partially over the flush valve actuator 25, whereby depressing the lever 140 will depress the flush valve actuator 25 and the linkage assembly 134, thus switching the state of the retention tray valve 125 and the flush valve 24 (triggering either a full volume or reduced flush volume depending on the default resting state of the retention tray valve 125).

Figure 9A:
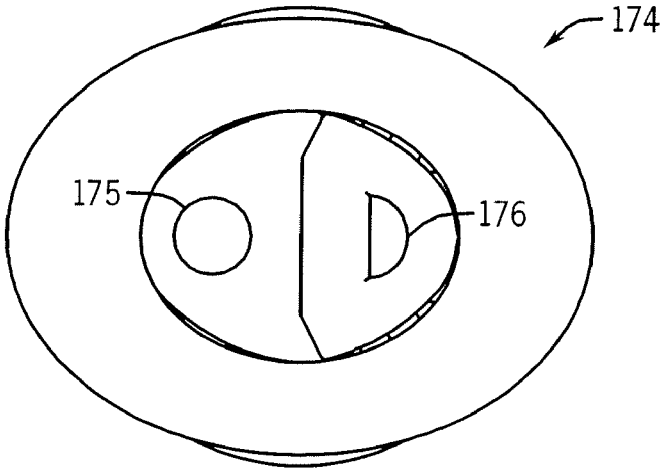
Figure 9B:
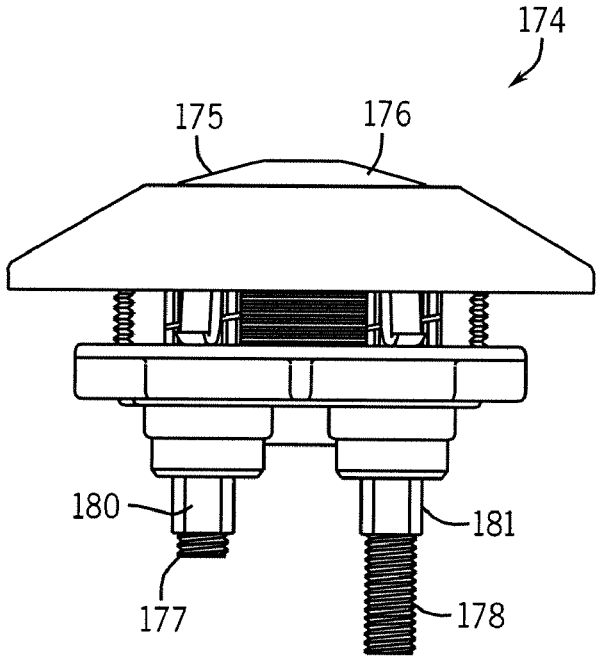
Figure 9C:
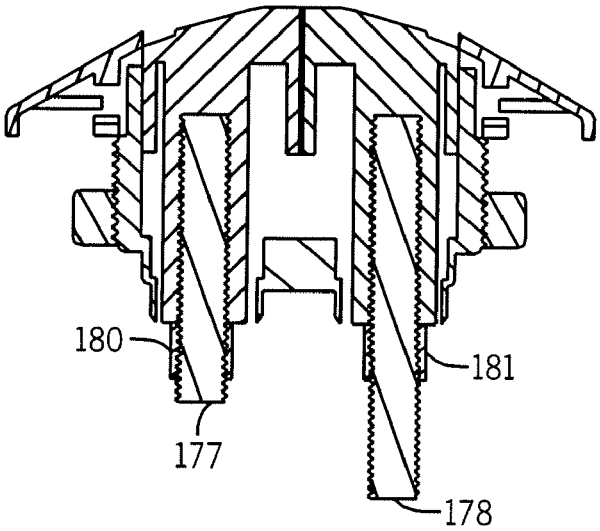

In one embodiment, the tank 10 is placed within a standard-type toilet tank (not shown). The top of the toilet tank includes the flush actuation mechanism, one embodiment of which is shown in FIGS. 9A-9C that is engaged by the user. A flush selector 174 may be provided to allow a user to actuate the system. The flush selector 174 is preferably located on an outer surface (not shown) of the toilet tank (not shown). In one embodiment, a partial flush button 176 and a full flush button 175 are provided. In one embodiment, adjustable striker stems 177 and 178 extend, respectively, from the partial flush button 176 and the full flush button 175. The adjustable striker stems 177, 178 have an adjustable length to allow for variations in the toilet tank size/shape so as to ensure that depressing either of the buttons 176, 177 will result in a proper actuation sequence of the appropriate flush valve 24 and tray valve 125. In an exemplary embodiment, one adjustable striker step 177 is shorter than the other adjustable striker stem 178 to accommodate the presence of the lever 140 underneath the shorter adjustable striker stem 177. Thus, in this embodiment, actuation of the button having the shorter adjustable striker stem 177 (the full flush button 175 in FIG. 9B) will actuate both the retention tray valve 125 (via the retention tray actuation linkage assembly 134) and the flush valve 24. While it will be appreciated that the shorter adjustable striker and buttons can be configured according to the embodiment of the retention tray 120 selected, the illustrated embodiment of FIG. 9B would result in a full flush event when the full flush button 175 associated with the shorter adjustable striker stem 177 is actuated.

In one embodiment, the buttons 175, 176 include an adjustable height mechanism 177, 178 respectively. One non-limiting example is shown in FIG. 9C. The adjustable striker stems 177 and 178 are threadably engaged with the flush actuation mechanism; and each is held in place by a nut 180, 181 respectively. The height adjustment mechanism 177 provides adjustability to an installer in order to accommodate variability in the toilet tank size/shape of various manufacturers.

In one embodiment, an automatic flush actuation system is utilized via sensorization as known in the art. A presence sensor can be placed so as to be able to detect the presence of a user. Logic, as known in the art, may be used for determining based on sensor information, whether a flush event should occur and whether the flush event should be a full flush or a partial flush. For example, a presence sensor may be armed when a user's presence is detected for at least 8 seconds. When presence is no longer detected, a flush event is triggered, such as after 4 seconds following the user leaving the sensor's range, with a flush volume depending on the length of time the user was present. For longer use events, both the flush valve and the retention tray valve would open to allow a full volume flush. For shorter use events, only the flush valve would open, with the retention tray valve closing to retain a portion of the tank water volume to effectuate a reduced volume flush.

The foregoing description of embodiments of the present invention have been presented for purposes of illustration and description. It is not intended to be exhaustive or to limit the present invention to the precise form disclosed, and modifications and variations are possible in light of the above teachings or may be acquired from practice of the present invention. The embodiments were chosen and described in order to explain the principles of the present invention and its practical application to enable one skilled in the art to utilize the present invention in various embodiments, and with various modifications, as are suited to the particular use contemplated.

What is claimed is:

1. A dual flush system comprising:

a pressure flushing tank defining an internal volume and having an inlet and an outlet;

an air inducer operatively connected to the inlet and configured to pressurize the pressure flushing tank;

a retention tray disposed within the pressure flushing tank, the retention tray having both a retention tray opening and a central opening disposed in a bottom portion of the retention tray, the central opening having a column rising therefrom and forming a wall, the retention tray defining a volume;

a flush valve for controlling the outlet, the flush valve extending from the outlet, through the central opening of the retention tray;

a retention tray valve disposed adjacent to the retention tray opening for controlling the retention tray opening, the retention tray valve comprising a valve seal engageable with the retention tray opening, the valve seal having a valve stem connected thereto;

a flush selector in communication with the retention tray valve and the flush valve, wherein actuation of the flush selector in a first direction actuates the flush valve for a partial flush and actuation of the flush selector in a second direction actuates the flush valve and the retention tray valve for a full flush.

2. The dual flush system of claim 1, wherein the retention tray valve further comprises a valve seat is disposed on an exterior surface of the bottom portion of the retention tray, surrounding a periphery of the retention tray opening, the valve seal engaged with the valve seat such that when the retention tray valve is opened the valve seal unseats exterior to the retention tray.

3. The dual flush system of claim 1, wherein the retention tray valve further comprises a valve seat disposed on an interior surface of the bottom portion of the retention tray, surrounding a periphery of the retention tray opening, the valve seal engaged with the valve seat such that when the retention tray valve is opened the disk valve seal unseats interior to the retention tray.

4. The dual flush system of claim 1, further comprising a retention tray actuation linkage assembly in communication with the valve stem.

5. The dual flush system of claim 4, wherein the retention tray actuation linkage assembly includes an actuation rod extending upward from the valve stem substantially perpendicular to the bottom portion of the retention tray, the retention tray actuation linkage assembly further in communication with the flush selector disposed on an outer surface of the pressure flushing tank, whereby actuation of the flush selector engages the retention tray actuation linkage assembly and opens the retention tray valve.

6. The dual flush system of claim 5, wherein the retention tray actuation linkage assembly further comprises a lever positioned on the outer surface of the pressure flushing tank in communication with the actuation rod and positioned adjacent to the flush selector.

7. The dual flush system of claim 4, wherein the retention tray actuation linkage assembly comprises at least one seal to preserve the integrity of the pressure flushing tank when under pressure.

8. The dual flush system of claim 6, wherein the flush selector comprises a full flush button and a partial flush button with the lever positioned between the full flush button and the flush selector such that actuation of the full flush button engages the lever, opening the retention tray valve as well as actuating the flush valve and initiating a flush cycle and wherein actuation of the partial flush button engages the flush valve but not the lever.

9. The dual flush system of claim 8, wherein each of the full flush button and the partial flush button has associated therewith an adjustable height mechanism for enabling the respective button to be utilized with water closets of various size.

10. A pressure flushing device, comprising:

a flush vessel defining an internal volume and in fluid communication with a water inlet line and a water outlet line;

an air inducer disposed between the water inlet line and the flush vessel such that water flowing into the flush vessel is mixed with air, pressurizing the internal volume of the flush vessel;

a flush valve disposed within the flush vessel for controlling flow of water out of the flush vessel;

a water retention tray assembly, comprising:

a tray housing having an outer wall defining a volume and being open on at least one side to the interior of the flush vessel, the tray housing having a tray valve opening and a central opening, the central opening having a column rising therefrom forming a wall;

a tray valve adjacent to the tray valve opening for controlling flow of water out of the water retention tray assembly into the flush vessel;

the tray valve including a valve seat and a valve seal;

an retention tray actuation linkage assembly in communication with the tray valve and the flush valve, the retention tray actuation linkage assembly including an actuation rod operatively connected to the valve seal and extending through the flush vessel housing, the retention tray actuation linkage assembly further including a lever moveably connected to a top surface of the flush vessel and operatively connected to both the rod and the flush valve;

wherein actuation of the lever in a first direction actuates the flush valve, causing all of the water in the flush vessel except the volume contained in the tray housing to flow through the water outlet line, resulting in a reduced flush, and wherein actuation of the lever in a second direction actuates the flush valve and the tray valve, causing all of the water in the flush vessel to flow through the water outlet line, resulting in a full flush.

11. The pressure flushing device of claim 10, wherein the valve seat is disposed on an exterior surface of the tray housing such that when the tray valve is opened the valve seal is unseated and exterior to the tray housing.

12. The pressure flushing device of claim 10, wherein the valve seat is disposed on an interior surface of the tray housing such that when the tray valve is opened the valve seal is unseated and interior to the tray housing.

13. The pressure flushing device of claim 10, wherein the flush selector comprises a full flush button and a partial flush button with the lever positioned between the full flush button and the flush selector such that actuation of the full flush button engages the lever, opening the retention tray valve as well as actuating the flush valve and initiating an flush cycle and wherein actuation of the partial flush button engages the flush valve but not the lever.

14. The pressure flushing device of claim 13, wherein each of the full flush button and the partial flush button has associated therewith an adjustable height mechanism for enabling the respective button to be utilized with water closets of various size.

15. The dual flush system of claim 1 further comprising a retention tray valve biasing mechanism, the retention tray valve biasing mechanism holding the valve seal in engagement with the retention tray when the flush selector is not actuated such that the default flush is a reduced flush.

16. The dual flush system of claim 1 further comprising a retention tray valve biasing mechanism, the retention tray valve biasing mechanism biasing the valve seal away from the with the retention tray when the flush selector is not actuated such that the default flush is a full flush.

17. The pressure flushing device of claim 10, wherein the tray housing has a volume of about 0.33 gallon.

18. The pressure flushing device of claim 10 further comprising a retention tray valve biasing mechanism, the retention tray valve biasing mechanism holding the valve seal in engagement with the retention tray opening when the lever is not actuated such that the default flush is a reduced flush.

19. The pressure flushing device of claim 10 further comprising a retention tray valve biasing mechanism, the retention tray valve biasing mechanism biasing the valve seal away from the with the retention tray opening when the lever is not actuated such that the default flush is a full flush.

20. The pressure flushing device of claim 10, wherein the retention tray actuation linkage assembly comprises at least one seal to preserve the integrity of the flush vessel when under pressure.

* * * * *